US005162793A

United States Patent [19]

Plost et al.

[11] Patent Number: 5,162,793

[45] Date of Patent: Nov. 10, 1992

[54] DRAIN PLUG ABSENCE INDICATOR

[76] Inventors: Gerald N. Plost, 1729 E. 19th, Tulsa, Okla. 74104; Henry A. Hodgson, 1410 E. 33rd, Tulsa, Okla. 74105

[21] Appl. No.: 792,539

[22] Filed: Nov. 12, 1991

Related U.S. Application Data

[63] Continuation-in-part of Ser. No. 676,871, Mar. 28, 1991.

[51] Int. Cl.[5] ..... G08B 23/00

[52] U.S. Cl. ..... 340/984; 114/197; 116/26; 340/568; 340/686

[58] Field of Search ..... 340/984, 686, 568, 687, 340/605; 114/197; 200/61.42, 61.44, 81.9 M, 183, 184, 187; 116/26, 112, 204, 265

[56] References Cited

U.S. PATENT DOCUMENTS

| | | | |
|---|---|---|---|
| 3,821,699 | 6/1974 | Marus et al. | 340/686 |
| 3,896,280 | 7/1975 | Blake | 340/686 |
| 4,516,515 | 5/1985 | Johnson | 114/197 |
| 4,542,373 | 9/1985 | Hillock | 340/686 |
| 4,843,376 | 6/1989 | Wagner et al. | 340/568 |
| 4,930,657 | 6/1990 | Walker | 114/197 |
| 5,047,753 | 9/1991 | Birchfield | 114/197 |

*Primary Examiner*—Jin F. Ng

*Assistant Examiner*—Brent A. Swarthout

*Attorney, Agent, or Firm*—Head & Johnson

[57] ABSTRACT

Apparatus for indicating the absence of a drain plug in a boat drain when the boat is in a launch condition includes an electrically activated alarm connected in series with an electrical power source and a control circuit for connecting and disconnecting the alarm to the power source. The control circuit is contained in a housing mounted proximate the boat drain on an exterior portion of the boat and includes a normally open switch closable by immersion of contacts in water and operable in response to an actuator mounted on the drain plug so that, when the drain plug is properly seated in the boat drain, the switch will be in an open condition. Thus, if the drain plug is not properly seated in the drain when the boat is launched into the water, the control circuit will be completed by immersion of the contacts in the water and the alarm will be activated. However, if the drain plug is properly seated, the switch will be in an open condition and the alarm will not be activated, even when the boat is in a launch condition. The housing can be mounted proximate the drain in a position such that the contacts are immersed at a level at or below the level of the drain so that the alarm will be activated prior to the entry of water into the drain.

16 Claims, 2 Drawing Sheets

DRAIN PLUG ABSENCE INDICATOR

RELATED APPLICATIONS

This application is a continuation-in-part of our presently pending application Ser. No. 07/676,871, filed Mar. 28, 1991, and entitled "Drain Plug Absence Indicator", inventors Gerald N. Plost and Henry A. Hodgson.

BACKGROUND OF THE INVENTION

This invention relates generally to accessories for water craft and more particularly concerns devices for signalling the absence of a drain plug from a boat drain when the boat is in a launch condition.

Prior art devices directed at saving the boating enthusiast from the embarrassment, aggravation and work resulting from launching a boat with an open drain fall into two basic categories. One category includes those devices responsive solely to the physical presence of a plug in the drain. In this category the alarm indicia are activated by the presence or absence of the plug in the drain and the alarm is activated regardless of the launch condition of the craft. For visual indicators which do not constantly bombard the senses, this can be an acceptable arrangement, but such indicators are inadequate in actual launch conditions because they require the boatman to physically observe the indicia. The boatman is still reliant on memory to check for the presence of the plug by looking at the indicia. For audio indicators of this type, the plug must always be in the drain, even if the boat is not in a launch condition, to prevent a constant sounding alarm. Of course, a manual interrupt could be used to disconnect the circuit, but such an interrupt would, be self-defeating since it would disconnect the system and again place the burden of memory on the boatman. The other category includes those devices responsive to the presence of water to activate the alarm. Some water responsive devices are presently known, but are actuated by either the presence of water in or the flow of water into the boat. Consequently, while such devices are satisfactory to minimize the embarrassment, aggravation and work above referred to, they do not eliminate it.

An additional problem with known indicator devices is that they require insertion and removal of the drain plug from a position inside of the boat. This can be a very inconvenient operation, particularly when the drain plug is located beneath floor boards or is inaccessible due to the presence of other boat equipment such as engines, pumps and the like.

It is therefore an object of the present invention to provide a drain plug absence indicator which gives an audible warning only if the boat is in a launch condition and the drain plug is absent from the drain. Another object of the present invention is to provide a drain plug absence indicator capable of giving an alarm prior to the flow of water through the drain. And it is an object of the present invention to provide a drain plug indicator which allows insertion and removal of the drain plug from a position outside of the boat.

SUMMARY OF THE INVENTION

In accordance with the invention, apparatus is provided for indicating the absence of a drain plug in a boat drain when the boat is in a launch condition. The apparatus includes an electrically activated alarm, such as a horn, connected in series with an electrical power source, such as the 12 volt battery normally associated with a boat's electrical system, and a control circuit for connecting and disconnecting the alarm to the power source. The control circuit is contained in a housing mounted proximate the boat drain on an exterior portion of the boat. The circuit includes a pair of spaced apart electrical contacts exposed externally of the housing so that immersion of the contacts in water will complete the electrical connection between them. The circuit also includes a mechanically operable switch, such as a magnetically actuated Hall effect switch. A switch actuator, such as a magnet in the case of the magnetically actuated Hall effect switch, is mounted on the drain plug in such a fashion that, when the drain plug is properly seated in the boat drain, the actuator will operate the Hall effect switch to disconnect the alarm. Thus, if the drain plug is not properly seated in the drain when the boat is launched into the water, the control circuit will be completed by immersion of the spaced apart contacts in the water and the alarm will be activated. However, if the drain plug is properly seated, the mechanically actuated Hall effect switch will open the control circuit and the alarm will not be activated, even when the boat is in a launch condition. The housing can be mounted proximate the drain in a position such that the water connectible spaced apart contacts are at a level at or below the level of the drain. Thus, the alarm will be activated prior to the entry of water into the drain.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
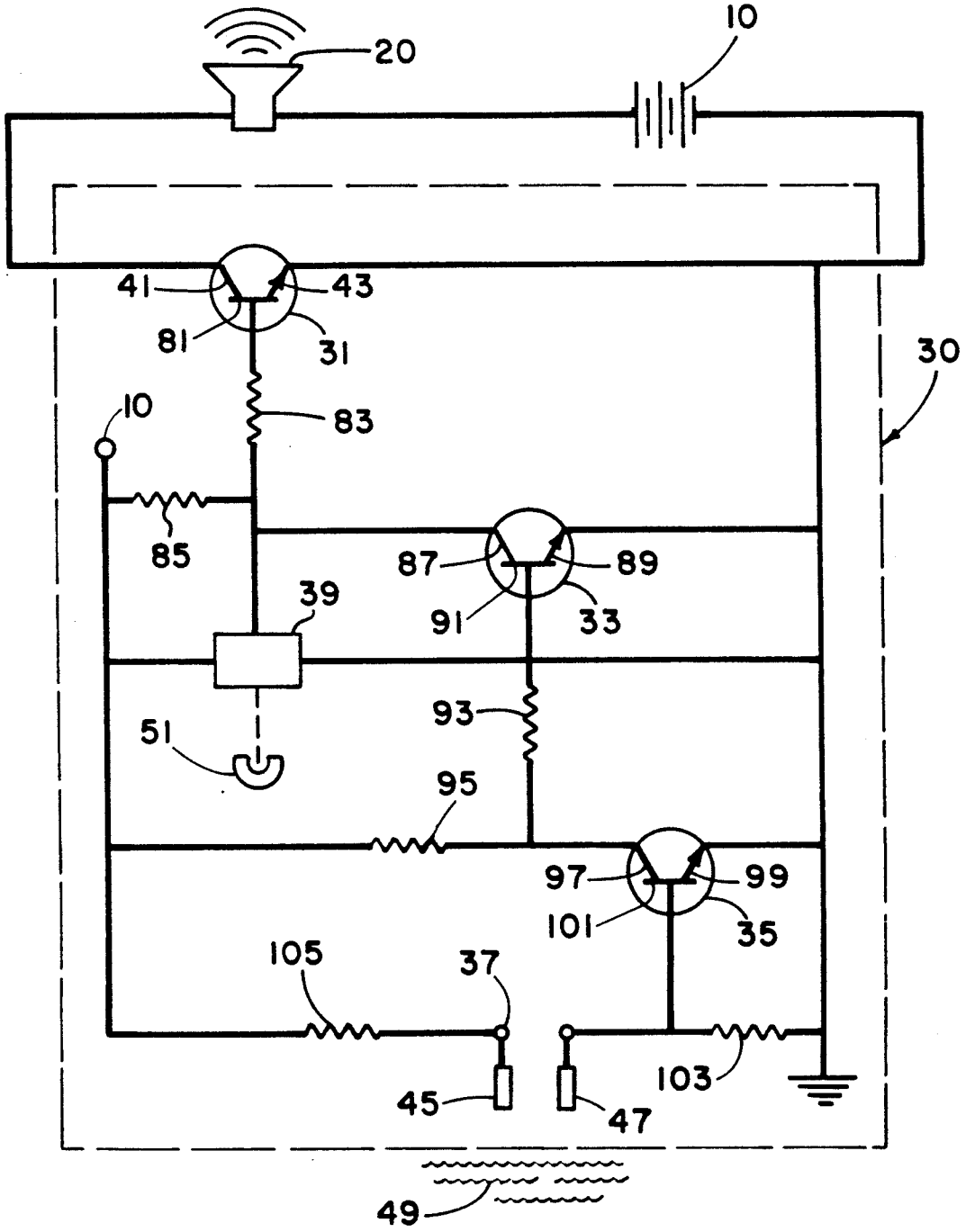
FIG. 1 is a schematic diagram of a preferred embodiment of the power and control circuits of the present invention.

Turning first to FIG. 1, a schematic diagram of a preferred embodiment of the drain plug absence indicator is illustrated. The circuit includes series connected power source 10, such as the 12 volt battery normally used to power a boat's electrical system, alarm indicator 20, preferably audible such as a horn or bell, and control circuit 30 for controlling the electrical connection between the power source 10 and the alarm 20.

In the preferred embodiment of the control circuit 30 illustrated in FIG. 1, control is accomplished by use of three grounded emitter transistors 31, 33 and 35, a normally open switch 37 and a Hall effect switch 39. As shown, the boat power source 10 is series connected with the alarm indicator 20 to the control circuit 30 through the collector 41 and the emitter 43 of the alarm on/off transistor 31. The base 81 of the on/off transistor 31 is connected through a resistor 83 to the source 10 through a second resistor 85, to the Hall effect switch 39 and to the collector 87 of the normally on transistor 33. The Hall effect switch 39 is connected to the source 10 and to ground. The base 91 of the normally on transistor 33 is connected through a resistor 93 to the source 10 through another resistor 95 and to the collector 97 of the normally off transistor 35. The base 101 of the normally off transistor 35 is connected through a resistor 103 to ground and to one contact 47 of the water operated switch 37. The other contact 45 of the water operated switch 37 is connected through a resistor 105 to the source 10. In the operation of the control circuit 30, the resistor 103 connected to the base 101 of the normally off transistor 35 maintains the transistor 35 in its off condition. When the contacts 45 and 47 of the normally open switch 37 are completed by immersion of the switch 37 in water 49 the resulting current to the base 101 turns on the normally off transistor 35. When the normally off transistor 35 is turned on, current through the resistor 93 connected to the base 91 of the normally on transistor 33 is diverted to ground through the emitter 99 of the normally off transistor 35. Thus, normally on transistor 33 is turned off. As a result, the resistor 83 connected to the base 81 of the on/off transistor 31 is no longer grounded and current is applied from the source 10 through the resistors 85 and 83 in the base circuit 81 of the on/off transistor 31. This turns on the on/off transistor 31, completing the power circuit to the alarm indicator 20. Thus, it can be seen that when the water operated switch 37 is closed by immersion in water, the result is completion of the power circuit to the alarm unless the presence of a magnetic field operates the Hall effect switch 39. If the Hall effect switch 39 operates, it connects the base circuit 81 of the on/off switch 31 to ground, turning off the on/off switch 31 and disconnecting the power circuit to the alarm 20. When the Hall effect switch 39 is activated, the power circuit to the alarm is disconnected whether or not the water operated switch 37 is immersed in water.

In a typical application using a 12 volt source 10, acceptable circuit component values would be:

| | |
|---|---|
| Transistors 31, 33 and 35 | MMST-A13 |
| Resistors 85, 95 and 105 | 10K |
| Resistors 83 and 93 | 100K |
| Resistor 103 | 1 MEG |

Figure 2:
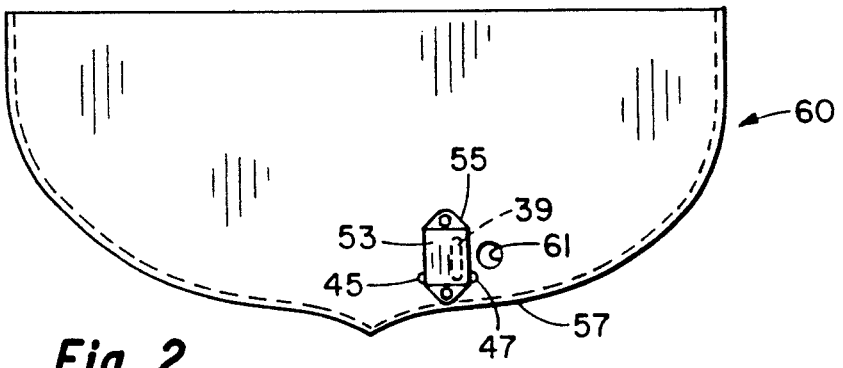
FIG. 2 is a rear elevational view illustrating a preferred embodiment of the control circuit housing of the present invention mounted on an exterior stern portion of a boat.

As is illustrated in FIG. 2, the stern 60 of the boat includes a drain 61. Mounted on the stern 60 of the boat is a housing 53 which contains the control circuit 30. The housing 53 may be typically approximately 1½ inches square and ⅝ inch thick and provided with flanges 55 and 57 by which the housing 53 may be screwed in place on the stern 60. Other configurations are of course possible depending on the specific circuit elements employed. The spaced apart contacts 45 and 47 are exposed on the exterior of the housing 53 and the Hall effect switch 39 is disposed within the housing 53. The housing 53 is mounted on the stern 60 proximate the drain 61, preferably in a relationship such that the contacts 45 and 47 are at a level approximately even with or below the level of the drain 61 and such that the Hall effect switch 39 is proximate the drain 61, for reasons to hereinafter become apparent. Preferably, the housing 53 forms a watertight enclosure protecting the control circuit 30.

Alternatively, the housing 53 may hold only the spaced apart contacts 45 and 47 and the remainder of the control circuit 30 may be separately housed for mounting internally or externally of the boat.

Figure 3:
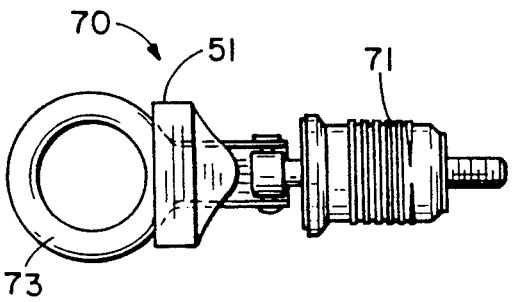
FIG. 3 is a side elevational view of a preferred embodiment of an improved drain plug for use with the present invention.
Figure 4:
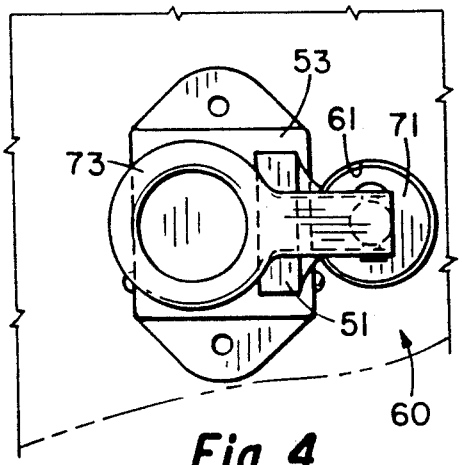
FIG. 4 is a rear elevational view illustrating the plug of FIG. 3 used in conjunction with the housing illustrated in FIG. 2.

Turning to FIGS. 3 and 4, a typical drain plug 70 for use with the boat drain 61 is illustrated which consists of a stopper portion 71 insertable in the drain 61 and a latching mechanism 73 which may be snapped to expand the stopper portion 71 and thus secure it within the drain 61. For the purposes of the present invention, the drain plug 70 has been improved by mounting the magnet 51 on it in such a position that, when the drain plug 70 is inserted in the drain 61 and the latching mechanism is moved into place, the magnet 51 will be juxtaposed in relation to the Hall effect switch 39 to actuate the switch 39 and put the on/off transistor 31 into an open condition. Of course, different types of switches may require different improvements to the plug.

In practice, the housing 53 containing the control circuit 30 will be screwed into position on the stern 60 of the boat proximate the drain 61 with the contacts 45 and 47 approximately at or below the level of the drain 61. The alarm 20 will be mounted in any desired position, preferably on the boat but possibly on the vehicle used to tow the boat. The control circuit 30 and the alarm 20 are connected to the power source 10 which, as was earlier mentioned, may be the battery normally associated with the boat's electrical system. An independent power source could of course be used. With the circuit thus connected, the user need do nothing more to accomplish its effective operation. If the boat is placed in a launch condition, that is the boat is either in the process of being launched or has already been launched into the water 49 when the drain plug 70 is not present in the drain 61, the Hall effect switch 39 will place the control circuit in its normally closed condition. When the boat is launched to the point that the contacts 45 and 47 become immersed in the water 49, the first switch 37 will be closed, completing the control circuit 30 and thus energizing the alarm 20. However, if the improved drain plug 70 is inserted in the drain 61, the juxtaposition of the magnet 51 with the Hall effect switch 39 will cause the Hall effect switch 39 to open the control circuit, preventing the alarm from operating regardless of whether the contacts 45 and 47 have been immersed in the water 49 or not.

Thus it can be seen that, in its normal condition, the circuit 30 is disconnected and no load is imposed upon the power source 10. Furthermore, the only time that the circuit 30 will be energized is during the simultaneous occurrence of the absence of the drain plug 70 and the immersion of the contacts 45 and 47 in the water 49. It should also be noted that the drain plug 70 is inserted and removed from the drain 61 from a position exterior to the boat and also that, by appropriate positioning of the housing 53, the alarm 20 will be sounded before the water 49 begins to enter the drain 61.

It will be obvious to one skilled in the art that a wide variety of control circuits and switching mechanisms equivalent to the control circuit 30 and the switches 37 and 39 herein illustrated may be employed. It is only essential that the on/off condition of the circuit be determined by a normally closed switch which will be opened in response to the presence of a drain plug in the drain and by a normally open switch which will be closed in response to the presence of water at a selected level in relation to the drain.

Thus, it is apparent that there has been provided, in accordance with the invention, a drain plug absence indicator that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. Apparatus for indicating the absence of a drain plug in a boat drain when the boat is in a launch condition comprising:

an electrically activated alarm means;

a power source electrically connected to said alarm means; and circuit means for controlling the electrical connection between said alarm means and said power source, said circuit means having a first normally open switching means electrically series connected with said alarm means and said power source, a second normally open switching means mountable on an exterior portion of the boat for closing in response to immersion thereof into water to close said first switching means and a third switching means for sensing the presence of the drain plug in the drain and for opening said first switching means in response to said sensing by said third switching means.

2. Apparatus according to claim 1, said first switching means comprising a normally off transistor.

3. Apparatus according to claim 1, said second switching means comprising a pair of spaced apart electrical contacts, a normally off transistor connected to be turned on upon immersion of said contacts in water and a normally on transistor connected to be turned off when said normally off transistor is turned on.

4. Apparatus according to claim 2, said contacts being disposed at a level approximately at or below the level of the drain.

5. Apparatus according to claim 1, said third switching means comprising a magnetically operated Hall effect switch.

6. Apparatus according to claim 5 further comprising magnet means mounted on the drain plug for operable juxtaposition in relation to said Hall effect switch when the plug is inserted in the drain.

7. Apparatus for indicating the absence of a drain plug in a boat drain when the boat is in a launch condition comprising:

a drain plug;

an operating means mounted on said drain plug;

an electrically activated alarm means;

a power source electrically connected to said alarm means; and circuit means for controlling the electrical connection between said alarm means and said power source, said circuit means having a first normally open switching means electrically series connected with said alarm means and said power source, a second normally open switching means mountable on an exterior portion of the boat for closing in response to immersion thereof into water to close said first switching means and a third switching means for sensing the presence of said operating means when the drain plug is in the drain and for opening said first switching means in response to said sensing by said third switching means.

8. Apparatus according to claim 7, said first switching means comprising a normally off transistor.

9. Apparatus according to claim 7, said second switching means comprising a pair of spaced apart electrical contacts, a normally off transistor connected to be turned on upon immersion of said contacts in water and a normally on transistor connected to be turned off when said normally off transistor is turned on.

10. Apparatus according to claim 9, said contacts being disposed at a level approximately at or below the level of the drain.

11. Apparatus according to claim 7, said third switching means comprising a magnetically operated Hall effect switch.

12. Apparatus according to claim 11, said operating means comprising magnet means for operable juxtaposition in relation to said Hall effect switch when said drain plug is inserted in the drain.

13. Apparatus for indicating the absence of a drain plug in a boat drain when the boat is in a launch condition comprising: a drain plug; a magnet mounted on said drain plug; an electrically activated alarm means; a power source electrically connected to said alarm means; a housing mounted on an exterior portion of the boat proximate the drain; and circuit means disposed within said housing having a first normally off transistor electrically connected in series with said alarm means and said power source, a pair of normally disconnected electrical contacts external to said housing electrically connectable by immersion thereof into water, a second normally off transistor connected to be turned on when said contacts are connected, a normally on transistor connected to be turned off when said second normally off transistor is turned on, said first normally off transistor connected to be turned on when said second normally off transistor is turned on and a Hall effect switch connected to turn off said first normally off transistor in response to said magnet when said drain plug is in an inserted condition in the drain.

14. Apparatus according to claim 13, said alarm means being an audible signal generator.

15. Apparatus according to claim 13, said power source being mounted on the boat.

16. Apparatus according to claim 13, said housing being mounted with said contacts at a level approximately at or below the level of the drain.

* * * * *